US005625969A

United States Patent [19]

Vogler

[11] Patent Number: 5,625,969

[45] Date of Patent: May 6, 1997

[54] LOW VISIBILITY PLACARD DISPLAY STAND

[76] Inventor: Michael N. Vogler, 49 Miranda Court, Thornhill, Ontario, Canada

[21] Appl. No.: 632,078

[22] Filed: Apr. 15, 1996

[51] Int. Cl.[6] ..... G09F 15/00

[52] U.S. Cl. ..... 40/611; 40/661

[58] Field of Search ..... 40/661, 611; 248/444.1

[56] References Cited

U.S. PATENT DOCUMENTS

| | | | |
|---|---|---|---|
| 4,726,132 | 2/1988 | Ernest | 40/661 |
| 4,742,633 | 5/1988 | Snediker | 40/611 X |
| 4,790,093 | 12/1988 | Ernest et al. | 40/661 |
| 5,058,300 | 10/1991 | Ernest et al. | 40/661 X |
| 5,331,757 | 7/1994 | Ernest et al. | 40/661 X |
| 5,442,873 | 8/1995 | Vogler . | |

*Primary Examiner*—Joanne Silbermann
*Attorney, Agent, or Firm*—William J. Daniel

[57] ABSTRACT

A display stand for display placards includes a support base formed of a preferably flat bottom wall, upstanding opposite side walls, and an interior partition wall defining between them two generally upwardly opening channels separated by the partition wall, and a cooperating pair of resilient transparent normally flat plastic sheets having their respective lower margins engaged in the channels with most of the remainder of their area in face-to-face planar contact for receiving the placard sandwiched therebetween. Opposite faces of the side walls and interior partition wall have mutually facing guide surfaces thereon which are inclined upwardly and inwardly whereby at least corresponding portions of the channels flare downwardly and outwardly to cause the lower margins of the plastic sheets when inserted into the channels to flex outwardly of each other at a significant angle out of the plane of their contacting faces and thus resiliently bias the remainder of the sheets together to secure the advertising matter in place. Preferably, each of the side walls has at least one longitudinal bead of elastomeric material on its inner face for elastic contact with the sheet lower margins. The support base is preferably extruded in tubular form and the longitudinal bead co-extruded therewith. Ends of the support base can be closed by end caps adapted for press-fitting engagement therewith and the end caps can have laterally extending stabilizing feet.

17 Claims, 2 Drawing Sheets

LOW VISIBILITY PLACARD DISPLAY STAND

FIELD OF THE INVENTION

This invention relates to a display stand for placards, signs and the like promotional material used especially for merchandizing purposes, such as the display to the purchasing public at the point of sale of goods and products of advertising matter, pricing data and similar information related to such goods and products, and is directed more particularly to a display stand utilizing transparent plastic sheets for supporting such placards, signs or similar material in upstanding position thereby imparting to the viewer the perception of invisible support.

CROSS-REFERENCE TO RELATED PATENT

The present invention is generally related to my earlier U.S. Pat. No. 5,442,873, issued Aug. 22, 1995, for "MOLDED PLASTIC PLACARD DISPLAY FRAME".

BACKGROUND OF THE INVENTION

It is common for a variety of goods and products to be stocked, often in quantity, for sale by merchants on shelves, racks, cases, bins, etc. for inspection and selection by consumers. The display of pricing information at the location of each particular product, i. e. at the point of sale, is ordinarily necessary as price tends to be a major factor in product choice. Moreover, certain products are often promoted or emphasized for sale at certain times by means of advertisement and/or price reduction and the display to the potential purchaser of the desired advertising information or reduction in price can be critical to the success of such promotion.

While small pricing tickets or tags can be attached, e. g. clipped, as is the usual practice, to an edge of the shelf or rack in proximity to each group of products, the amount of information that can be provided on tickets or tags is quite limited, being usually restricted to identity and price alone, making the exhibition of appealing advertising material to entice an undecided customer almost out of the question. In any event, this kind of display lacks the distinctive character required for significant impact on the perception of a prospective purchaser in that it does not differentiate from regular pricing tickets or stand out from the remainder of the merchandize in the area.

According to the invention of my earlier patent identified above, a display placard in sheet form was held within a open frame constituted of four rectilinear frame members connected together at adjacent ends into a rectangle. Three of the four frame members were formed with channels opening toward the frame interior for receiving margins of the placard along three of its sides with the fourth member having a lengthwise slot passing therethrough in coplanar relation to the channels of the other members for introduction of the advertising placard into the frame. At least one nip-like protuberance projected from an interior wall of the slot for engagement with the corresponding margin, or the edge thereof, of the placard to insure its retention within the frame.

The assembly of my prior patent represented a considerable improvement over similar prior art support frames for advertising matter as explained in the background section of the patent disclosure. It was, however, inherently subject to certain limitations. First, the size of the advertising placard that could be accommodated by a frame of a given dimensions was essentially restricted to the size of the frame. Hence, in order to display advertising matter in different size formats, it was necessary to have available frames corresponding to each of the different formats. In as much as the merchandize offered for sale at the most retail establishments is typically large in volume and varied in nature, it was necessary for the establishment to maintain a relatively large inventory of frames.

Also, a certain minimum thickness tended to be required for the advertising placard to permit the same to be inserted readily into and held effectively by the frame. Thus, the placard had to be printed on cardboard, paperboard or the similar relatively stiff stock rather than on the more flimsy (but less expensive) letter or newsprint weight paper. Likewise, the shape of the placard was restricted to a rectangular shape thereby limiting the creative expression of the advertising medium.

In addition, while the patented frame possessed a neat, simple appearance and could be made reasonably attractive by appropriate contouring of the cross-section of its members, its appearance was stereotypical of sign holders and lacked variety and freshness of visual impression.

OBJECTS OF THE INVENTION

The ultimate object of the present invention is a display stand for advertising material and the like that is free of the above drawbacks and is capable of accommodating advertising matter in an almost unlimited variety of formats carried on virtually any kind of sheet stock and itself is characterized by a fresh original appearance.

Another object of the invention is a display frame wherein advertising matter is supported between an opposed pair of transparent plastic sheets that are virtually invisible thereby giving the perception of the advertising matter "floating in thin air".

BRIEF DESCRIPTION OF THE ACCOMPANYING DRAWINGS

An illustrative embodiment of a display stand according to the present invention is shown in the accompanying drawings, in which FIG. 1 is a front perspective view showing the frame in operative position with a display placard supported thereby, the placard for purposes of illustration being indicated in phantom lines;

DETAILED DESCRIPTION OF ILLUSTRATIVE EMBODIMENT

Figure 1:
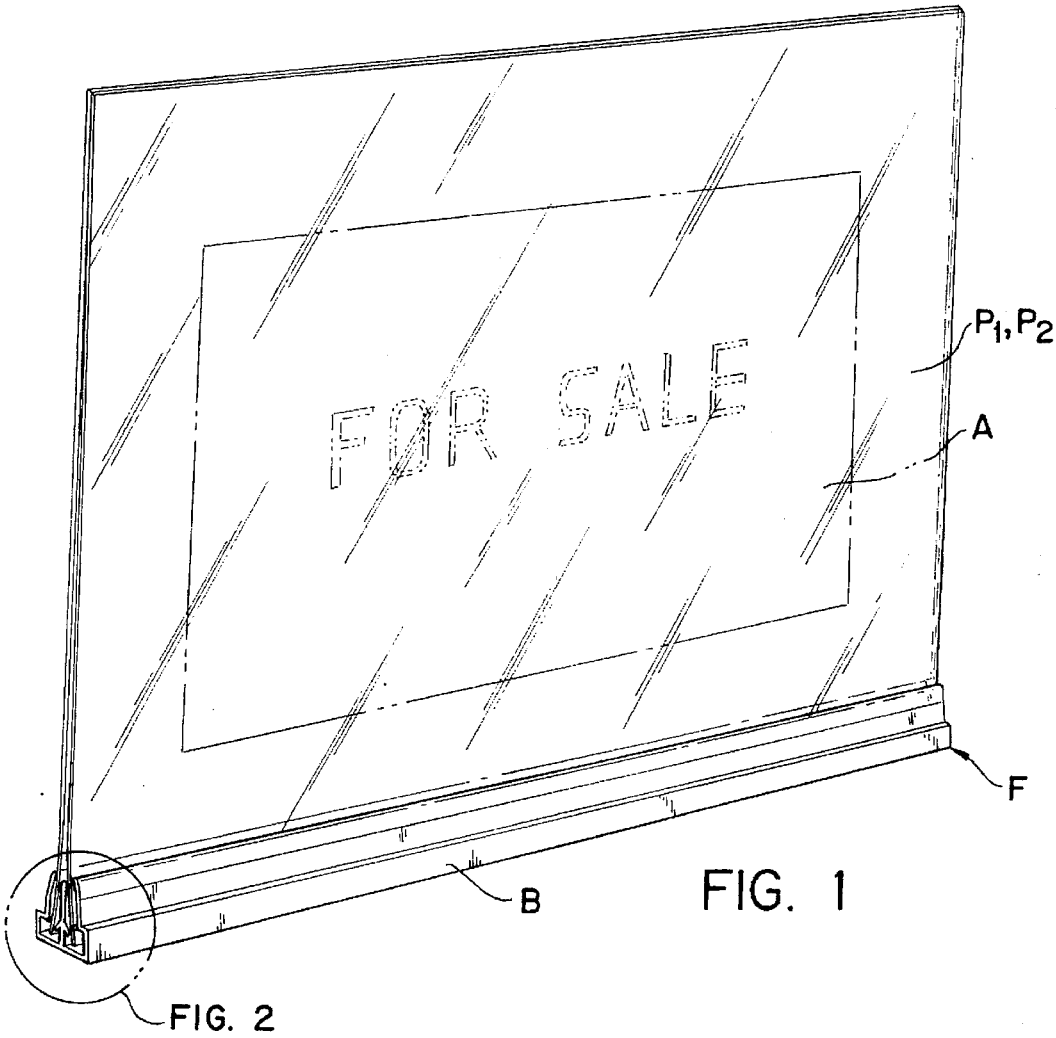

In a preferred embodiment as illustrated in FIG. 1 of the drawings, the display frame of the invention, generally designated F, consists of an elongated substantially rigid supporting base B and a cooperating pair of substantially planar generally resilient transparent plates P1. P2 which are seated along lower margins thereof within base B and held thereby in generally upright position with the desired advertising or promotional material pressed therebetween, as suggested in phantom lines at A.

Base B is constituted by a bottom wall 10, side walls 12, 12' generally upstanding from opposite lateral edges of bottom wall 10, and an interior partition wall 14 also upstanding from bottom wall 10 located intermediate the side walls 12, 12' and dividing the interior space bounded by the side and bottom walls into two upwardly opening channels C, C' each of which receives a lower margin M, M' along one side of a plate P,P'. The several walls of the base B preferably extend continuously over the same length with the lower edges of the opposite side walls and partition wall joined to the bottom wall. Preferably, base B is of unitary construction although the walls thereof could conceivably be made separately and assembled together. The base can conveniently be formed by extrusion longitudinally as a unit, preferably from a suitably rigid and durable extrudable plastic material, e. g. a high impact polyvinyl carbonate resin and cut to the desired length. Alternatively, base B could be extruded of metal such as aluminum and instead of extrusion, the base might be formed by molding, e.g. injection molding, from either plastic or metal.

As is recognized, polycarbonate resin can be transparent when molded and if the resin is used in this state for the base, the illusion of the frame "floating in space" is enhanced. Or the resin of the base can be colored either with clear colorants or opaque pigments to color coordination with a particular advertising motif or concept, Plates P1, P2 are of optically clear plastic such as acrylic sheet of such thickness, e. g. about 1/16", as to possess sufficient stiffness as to be readily self-supporting in an upright position without collapse. Furthermore, the plates must have a definite resiliency so that they can be bent or flexed without fracture through an acute angle of up to say 15° or 20° and return to planar condition upon release of the bending force. As shown in FIG. 1, in an ordinary case, plates P1, P2 are rectangular in configuration but they could have other shapes (not shown) provided there is a linear edge along one side for seating within the channels of base B. For example, they could be circular, oval or even of some irregular or "free-form" contour with one linear side edge. Also, they would usually have a matching configuration although if desired for some special purpose, one could be smaller than the other or each could be smaller in one dimension but larger in another dimension.

The purpose of channels C1, C2 is to receive a lower margin M, M' of each of plates P,P' and maintain the lower plate margins when seated within the channels the lower margins of the resilient plates P1, P2 in a slightly bent or flexed condition out of the plane of the plates as a whole so that upper portions of the plates are resiliently urged or biased by the natural resiliency of the plates into flat face-to-face contact. Thus, it is necessary for the channels C1, C2 to have a slight but distinct inclination from the vertical of at least about 5° up to about 15°–20°. This inclination takes opposite directions for the two channels so that they exhibit maximum separation between their lower ends adjacent bottom wall 10 and converge upwardly and inwardly to a minimum separation (or even no separation at all) at their open upper ends.

The angle of channel inclination is not critical. It should be large enough that when the plate margins are flexed to that angle, the remainders of the plates (or at least a major portion thereof) are urged together by the natural resiliency of the plates with enough force to grip with reasonable security against slippage advertising matter arranged in sandwiched relation therebetween. But the angle cannot be so great as to exceed the elastic limit of the plastic and result in cracking or fracture of the flexed plate. This limit obviously depends upon the choice of the particular plastic as well as the thickness of the plates.

Figure 2:
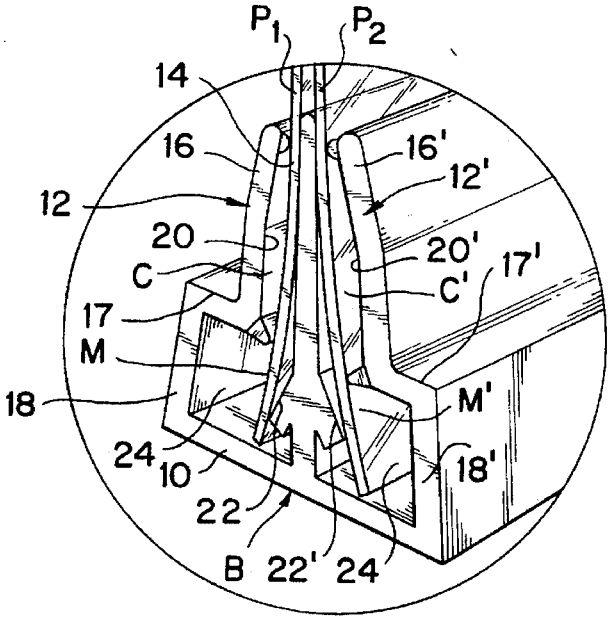
FIG. 2 is an enlarged detail view in perspective of the encircled region of FIG. 1, showing an end of the base of the frame in association with adjacent fragments of the opposed transparent plastic sheets cooperating therewith.

Interior partition wall 14 is ordinarily located along the center axis of the bottom wall, i.e. equidistant from the opposite side walls 12. The height or vertical extent of the partition wall can vary, as one will see by comparing FIGS. 2 and 3, for example. In the embodiment of FIG. 2, the free end of partition wall 14 is generally coterminous with the upper edges of opposite side walls 12; it could possibly extend above the edges of the side walls but this is normally less desirable. If partition wall 14 projects significantly above the upper edges of side walls 12, it causes some separation of adjacent regions of the two plates, the area of which separation increases as the exposed length of the partition wall increases. Such separation reduces the overall frictional engagement of the flexed plates for the advertising matter held therebetween and hence increases the chance of the advertising matter slipping out of its intended position. Some separation could certainly be tolerated, as indicated in the FIG. 1 embodiment, the degree of which will depend on such factors as the elastic properties of the plates, the selected angle of flexure, the roughness of the surface of the advertising matter, etc.

Figure 3:
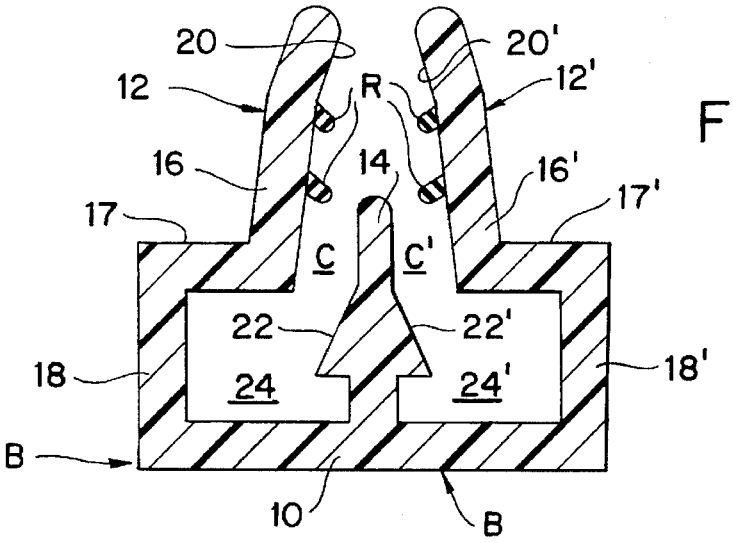
FIG. 3 is an enlarged view of a slightly modified base of the frame of the invention taken in section transversely across the base.

In the embodiment of FIG. 3, partition wall 14 terminates below the upper edges of side walls 12 which maximizes the total area of contact of the flexed plates and their grip upon the advertising matter. The effective height of partition wall 14 can perhaps be reduced to about ½ that of the side walls or possibly even less, provided that the shortened partition and the guide surfaces thereon effectively define the two channels. It will be appreciated that as the height of partition wall 12 is reduced, the risk of the lower margin of a plate finding its way into the wrong channel when being introduced therein is slightly increased.

Depending upon the height or vertical extent of interior partition wall 14, channels C1, C2 are either separated slightly at their upper ends (as well as at their lower ends) (FIG. 2) or merge together over an upper region (FIG. 3).

The desired vertical inclination of channels C1, C2 can be achieved by different structural ways, which in general have the common characteristic of providing of guiding surfaces on the inner faces of side wall 12, 12', as at 20, 20', and on the opposite faces of partition wall 14, as at 22, 22', which surfaces have the selected inclination. The guiding surfaces can be continuous from bottom to top but because of the natural stiffness of the plates, the guiding surfaces can equally well be discontinuous or partial in the height or vertical extent of the channels provided the necessary degree of contact with the plate lower margins is preserved. The latter option is especially appropriate for the lower regions of both the side walls, as suggested in the embodiment of FIG. 2, and the interior partition, as seen in all embodiments.

Figure 4:
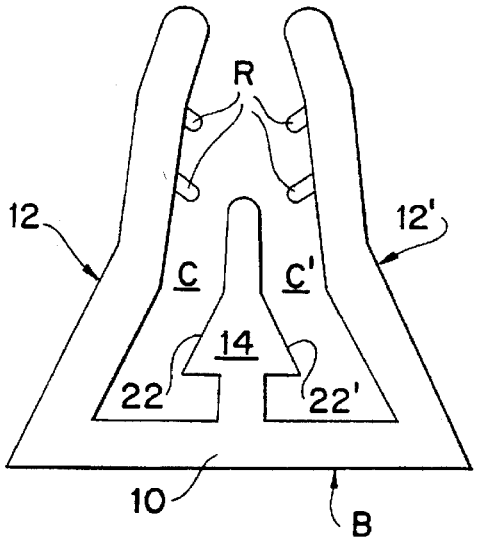
FIG. 4 is an enlarged view of another embodiment of the base of the frame taken in end elevation.

This option allows for considerable variation in the overall cross-sectional or transverse shape of the base B. On the one hand, the base as a whole can have a generally triangular cross-section with the side walls inclined at the desired slight angle, or at an increasing slight angle, over virtually their entire vertical extent (see FIG. 4). On the other hand, the base can have a more or less square exterior contour (not shown) with side walls of increasing thickness from bottom to top to impart the desired inclination to their inner faces.

Or, the base can have some combination of these two configurations, as is suggested in FIGS. 2 and 3, where each side walls is bodily inclined, i. e. on both their inner and outer faces, at their upper ends 16. 16' down to a horizontal shoulder 17, 17' joined to a vertical or almost vertical lower wall section 18, 18;. In the latter case, the lower section of the channel can be laterally enlarged, as shown in FIGS. 2 and 3. The excess area thus created, indicated at 24, 24', is inconsequential since the required flexure of a plate margin is adequately imparted by the inclination of the upper side wall portion and of the opposite surface of the interior partition wall and the inner face of the lower section of a side wall does not make contact with a plate margin.

It is preferred to insure a tight, secure engagement of the lower margins of the transparent plates within the channels of the base that at least the upper portions of the opposite side walls thereof be provided with at least one longitudinal bead of a rubbery or elastomeric material, as at R. As seen in the illustrated embodiments, there can be two such beads R located at vertically spaced apart loci along the respective side walls. However, it has been found that a single bead situated approximately midway of the two beads depicted in the drawings affords an entirely adequate gripping action on a plate margin and if desired a greater number than two, say three, such beads could be used.

Preferably, a bead is laid in place against an inner face of a channel during the extrusion of the channels by co-extrusion. A suitable bead material is a low temperature polyvinyl carbonate resin which as is known in the art has a rubbery or elastomeric character. Due to its polycarbonate nature, the bead material is compatible with the rigid polycarbonate of the side wall and adheres effectively thereto without the need for special measures such as adhesives or the like. It will be apparent that for other rubbery or elastomeric bead material, an internal groove or notch could be formed during the extrusion longitudinally on the inner face of a side wall and the bead laid down in the groove at a downstream point of the extrusion and thereby embedded in the groove, with the use of an adhesive if needbe. As a still further option, a groove, which could be wider at the bottom than at the top, can be created by extrusion in the inner side of the channel side wall and a solid rubbery or elastomeric bead, e.g. of natural or synthetic rubbers and elastomeric copolymers, inserted subsequently therein, similar to the well known placement of flexible sealing flaps or "sweeps" on storm doors and windows.

Figure 5:
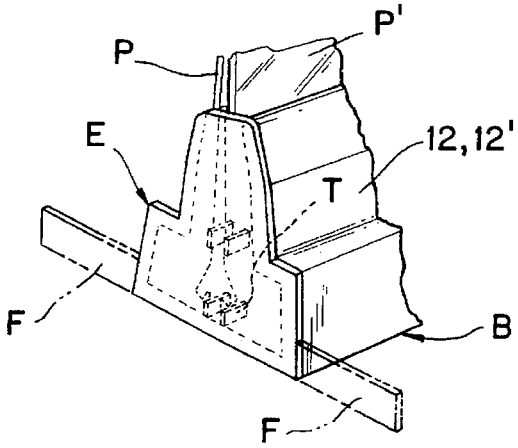
FIG. 5 is a detail view similar to FIG. 2 showing an optional end cap for closing an end of the base of the frame, the end cap being provided with lateral extensions to stabilize the frame is its normal vertical orientation.

The ends of a base can be finished to an acceptably neat appearance by grinding and/or polishing but if a more finished look is desired, this can be achieved by means of end caps E fitted to the ends of the base, such as is shown at one end of a base in FIG. 5. An end cap can desirably have the same shape as the cross-section of a base, as shown, although other shapes are certainly not excluded. While an end cap could be attached to a base end by adhesive or the like, the cap preferably includes means on its inner face for engagement with interior walls of the base channels. For instance, as indicated in broken lines in FIG. 5, spaced apart tongues or tabs T can project from the inner face of the cap for press-fitting engagement with the sides of the partition wall. For enhanced press-fit, if desirable, tabs T can converge slightly toward their free ends so as to resiliently grip the partition wall and thus hold the end cap securely in place. In another form, not shown, an end cap could have a perpendicular flange around its side edges arranged for overlapping contact with an end of a base and secured thereto either by means of an adhesive or the natural resiliency of the flange.

A further modification for the stand of the invention is the provision of feet or legs to thereby make the stand stably upstanding. One could, of course, expand the lateral dimensions of the base enough to achieve this result but this would involve added material costs and perhaps detract from the esthetics of the overall frame. Or the stand can be held in a desired position at a given sales location by means of a clamp employed for that purpose. But a preferred expedient to this end is the addition to the stand of feet which can conveniently be combined with the end caps, as shown in phantom lines at F in FIG. 5. The length or lateral extent of such feet will depends mainly on the overall height of the frame, which determines the tilting force to be resisted, and their height or vertical dimension is sufficient to render them reasonably rigid against bending in a vertical plane.

Obviously, the stand could be supported in vertical position in other ways. Instead of being combined with the end caps, the feet could be in the form of separate clips or the like (not shown) designed to clip or slip onto the bottom of the base with lateral wings or extensions similar to those shown at F.

The details of the specific extrusion molding technique employed for the invention will be obvious to one skilled in that art and a description thereof is not needed here.

During the course of the preceding description, a number of possible alternative or modifications have been noted, It will be appreciated, however, that other additional changes will be within the skill of those familiar with the art. Hence, the scope of the invention should be limited only as required by the express language of the appended claims.

That which is claimed is:

1. A display frame for supporting in a generally vertical position display placards which comprises an elongated substantially rigid base having a bottom wall, opposite side walls upstanding from opposite lateral edges of said bottom wall, said side walls having substantially coterminous upper edges, and an interior partition wall upstanding from the bottom wall generally intermediate the opposite side walls to define with the side walls two upwardly opening channels, said side walls and said partition wall carrying mutually facing cooperating interior guide surfaces sloping from the vertical to impart to said channels an upwardly converging inclination at a significant angle from the vertical, and a cooperating pair of substantially stiffly resilient transparent normally flat plastic sheets which extend upwardly from said base generally perpendicularly to said bottom wall of said base in face-to-face planar contacting relation over a substantial portion of their common area and have their respective lower end margins engaged within the respective channels and maintained by the inclination of said channels in generally outwardly flexed relation out of the plane of said substantial portion of their common area whereby a display placard can be inserted between the upwardly extending portion of said sheets and resiliently gripped thereby.

2. The display stand of claim 1 wherein each of said side walls is provided on the interior guide surface thereof with at least one longitudinal bead of elastomeric material for yieldable engagement with a lower margin of said transparent sheet present in said channel.

3. The display stand of claim 2 wherein the interior guide surfaces of each said side wall has at least two of said longitudinal beads of elastic material situated at loci spaced different distances from said bottom wall.

4. The display stand of claim 2 wherein said bead of elastic material is co-extruded with said tubular extrusion.

5. The display stand of claim 1 wherein said interior partition wall along an upper edge is substantially coterminous with upper edges of said side walls.

6. The display stand of claim 1 wherein said interior partition wall along an upper edge terminates short of upper edges of said side walls.

7. The display stand of claim 1 wherein said interior guide surfaces comprise upwardly and inwardly inclined surfaces on interior faces of each of said side walls and on opposite faces of said interior partition over at least a portion of their respective vertical extents.

8. The display stand of claim 1 wherein at least an upper portion of the respective side walls is inclined upwardly and inwardly toward the upper portion of the opposite side wall and said guide surfaces include inside faces of said upper portions of said side walls.

9. The display stand of claim 7 wherein said interior partition wall comprises a triangular portion and said guide surfaces are comprised by inclined side faces of said triangular portion.

10. The display stand of claim 8 wherein said inclined side faces of said triangular portion terminate in lower edges spaced from said bottom wall.

11. The display stand of claim 1 wherein said bottom wall, sides walls, and interior partition wall are integral.

12. The display stand of claim 10 wherein said bottom, side and partition wall are in the form of a tubular extrusion.

13. The display stand of claim 1 wherein said base has open ends which are closed by end caps fitting thereover.

14. The display stand of claim 1 including feet carried on said base for stabilizing the stand in upright position.

15. The display stand of claim 14 wherein said feet are formed as lateral extensions on said end caps.

16. The display stand of claim 1 wherein said bottom wall is generally flat.

17. The display stand of claim 16 wherein said side walls extend from lateral edges of said bottom wall upwardly at a significant converging angle from the vertical.

* * * * *